US008382264B2

(12) United States Patent
Huck et al.

(10) Patent No.: US 8,382,264 B2
(45) Date of Patent: Feb. 26, 2013

(54) UNIVERSAL INKJET CARTRIDGE

(75) Inventors: Donald D. Huck, Sanford, NC (US); Anthony D. Causey, Fuquay Varina, NC (US)

(73) Assignee: Static Control Components, Inc., Sanford, NC (US)

( * ) Notice: Subject to any disclaimer, the term of this patent is extended or adjusted under 35 U.S.C. 154(b) by 1434 days.

(21) Appl. No.: 12/011,338

(22) Filed: Jan. 25, 2008

(65) Prior Publication Data

US 2009/0189962 A1 Jul. 30, 2009

(51) Int. Cl.
*B41J 2/175* (2006.01)
*B41J 23/00* (2006.01)
*B41J 2/16* (2006.01)

(52) U.S. Cl. ..... 347/86; 347/37; 347/49

(58) Field of Classification Search ..... 347/86, 347/37, 49

See application file for complete search history.

(56) References Cited

U.S. PATENT DOCUMENTS

| | | | | |
|---|---|---|---|---|
| 5,519,422 | A | 5/1996 | Thoman et al. | |
| 6,017,118 | A | 1/2000 | Gasvoda et al. | |
| 6,183,077 | B1 | 2/2001 | Hmelar et al. | |
| 6,290,346 | B1 | 9/2001 | Santhanam et al. | |
| 6,375,315 | B1 | 4/2002 | Steinmetz et al. | |
| 6,547,378 | B2 | 4/2003 | Santhanam et al. | |
| 6,749,294 | B2 | 6/2004 | Haldorsen | |
| 6,773,087 | B2 | 8/2004 | Wazana et al. | |
| 7,104,641 | B2 | 9/2006 | Wazana et al. | |
| 7,156,491 | B2 | 1/2007 | Sturgeon et al. | |
| 2006/0017776 | A1 * | 1/2006 | Morton et al. | 347/49 |

* cited by examiner

*Primary Examiner* — Jannelle M Lebron

(57) ABSTRACT

A universal inkjet cartridge usable in an inkjet printer the inkjet cartridge having an inkjet tank, the inkjet tank storing ink and having an upper surface and a lower surface is disclosed. Mounted on the lower surface are configurable color identification tabs and mounted on the upper surface are printer identification fins, the configurable color identification tabs are configured to allow the universal inkjet cartridge to be used in multiple inkjet cartridge locations within the inkjet printer identified by the printer identification fins.

6 Claims, 12 Drawing Sheets

UNIVERSAL INKJET CARTRIDGE

FIELD OF INVENTION

The present invention relates to remanufacturing and modifying imaging process cartridges, such as printer cartridges, and more particularly to an inkjet printer cartridge configurable to operate in multiple printer types or color types.

BACKGROUND

Printer cartridges are typically designed to provide the consumer a certain number of print copies before the toner or ink is exhausted. The total number of prints varies depending on the type, quality and density of the print provided by the printer. After all of the toner or ink is spent, the cartridges are either thrown away or recycled.

Within an inkjet printer, there may be four or more inkjet cartridges. Each of the inkjet cartridges may contain a specific color of ink. There may be up to seven color inkjet cartridges for each color inkjet printer, including black, magenta, yellow and cyan color cartridges. In some inkjet printers, the basic shape of the various inkjet cartridges may be very similar with only slight differences. For instance, all the cartridges may use the same print head or nozzle. The shape of the ink tanks may also be very similar. However, the printer manufacturers have developed a keying system to prevent the wrong inkjet cartridge from being installed into the incorrect cartridge location within the printer. Typically these keys may be a protrusion on the outside of the inkjet cartridge which may match up with a recess or set of recesses in the inkjet cartridge compartment. If a black inkjet cartridge is attempted to be inserted into a cyan location, the cyan keys prevent the black inkjet cartridge from being inserted.

Additionally, the inkjet cartridges may be designed to fit into one type of printer or family of printers. For instance, the various Hewlett Packard (HP) 83 inkjet cartridges (black, magenta, cyan, light cyan, light magenta, and yellow) may not be compatible for use in with other HP printer types such as the HP Edgeline family of printers, even though the cartridges may look very similar. The printer manufacturers may alter one or more physical characteristics of the inkjet cartridges. In some cases the differences may be an entirely new shape or the printer manufacturer may only change a minor detail such as an indentation or a protrusion in addition to the color keying for the individual color inkjet cartridge.

Commonly on some inkjet cartridges, there may be color indication tabs indicating the particular color of ink contained within the inkjet cartridge. In addition, there may also be printer identification fins which differentiate which printer or printer family the inkjet cartridge is compatible with. Because the color identification tabs line up with certain recesses within the printer as well as printer identification protrusions that line up with printer identification keys, the printer manufacturer may have to produce a different inkjet cartridge for each color for all of the various printers or printer families. This may be an inefficient way of offering inkjet cartridges when the inkjet cartridges may be very similar.

SUMMARY

The present invention recognizes the need for a universal inkjet cartridge that may be configured for use in any of the inkjet cartridge locations within a plurality of printers. The present invention may allow an inkjet cartridge manufacturer or remanufacturer the ability to produce one universal inkjet cartridge that may be configured for use in multiple locations with the same printer or possibly multiple locations with multiple printers.

A universal inkjet cartridge usable in an inkjet printer the inkjet cartridge having an inkjet tank, the inkjet tank storing ink and having an upper surface and a lower surface is disclosed. Mounted on the lower surface are configurable color identification tabs and mounted on the upper surface are printer identification fins, the configurable color identification tabs are configured to allow the universal inkjet cartridge to be used in multiple inkjet cartridge locations within the inkjet printer identified by the printer identification fins.

A universal inkjet cartridge usable in an inkjet printer the inkjet cartridge having an inkjet tank, the inkjet tank storing ink and having an upper surface and a lower surface is disclosed. Mounted on the lower surface are color identification tabs and mounted on the upper surface are configurable printer identification fins, the configurable printer identification fins are configured to allow the universal inkjet cartridge to be used in the same inkjet cartridge location in multiple inkjet printers identified by the configurable printer identification fins.

A universal inkjet cartridge usable in an inkjet printer the inkjet cartridge having an inkjet tank, the inkjet tank storing ink and having an upper surface and a lower surface is disclosed. Mounted on the lower surface are configurable color identification tabs and mounted on the upper surface are configurable printer identification fins, the configurable color identification tabs are configured to allow the universal inkjet cartridge to be used in multiple inkjet cartridge locations within the inkjet printer and the configurable printer identification fins are configured such that the universal inkjet cartridge is compatible in multiple inkjet printers.

A more complete understanding of the present invention, as well as further features and advantages of the invention, will be apparent from the following detailed description and the accompanying drawings.

DETAILED DESCRIPTION

Figure 1:
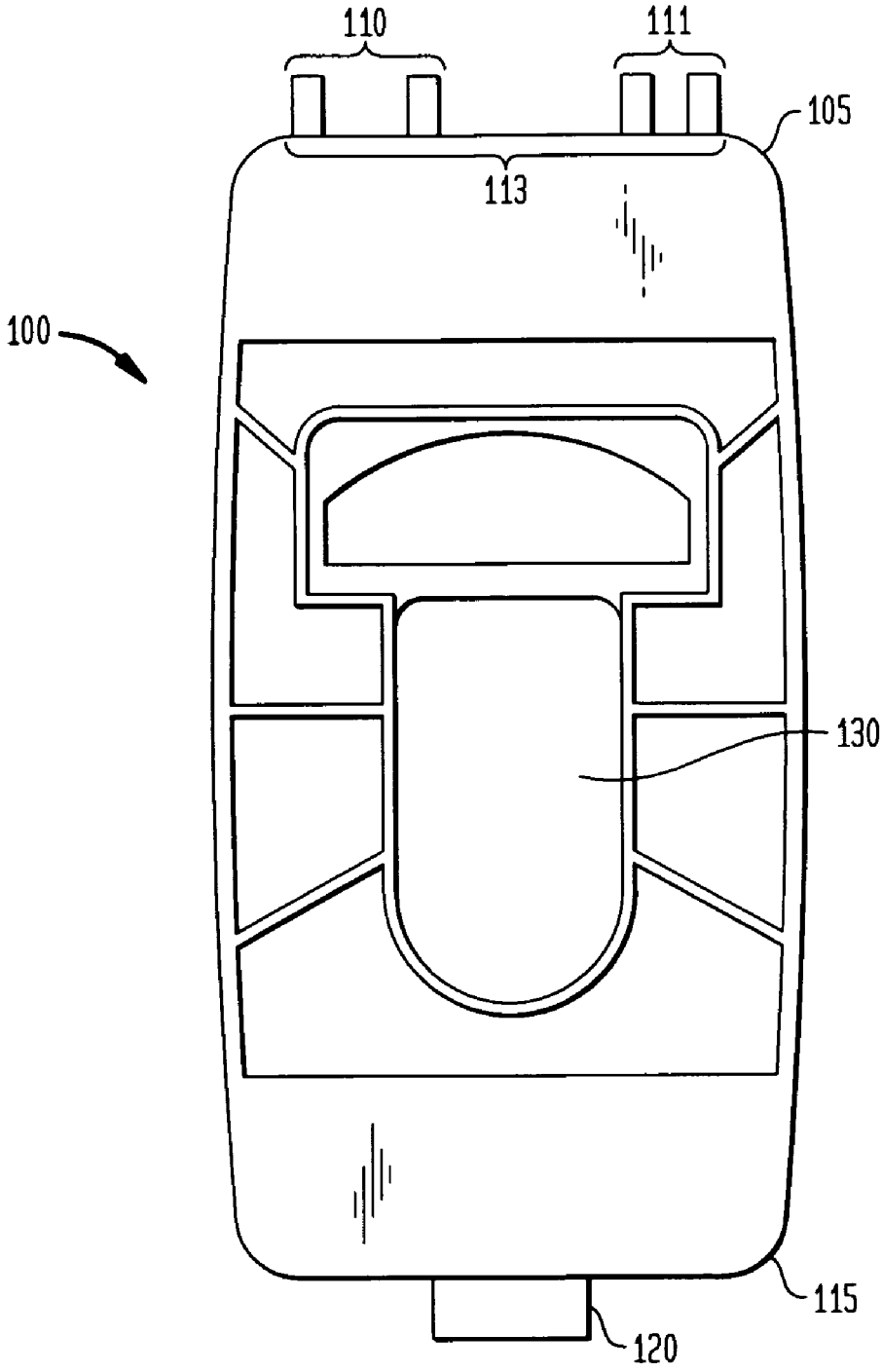
FIG. 1 (PRIOR ART)
FIG. 1 shows a top view of a prior art black inkjet cartridge compatible in the HP Edgeline printer family.

The following detailed description of preferred embodiments refers to the accompanying drawings, which illustrate specific embodiments of the invention. In the discussion that follows, specific systems and techniques for repairing, manufacturing or remanufacturing an imaging cartridge, such as a toner cartridge are used as examples. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Within the printer industry, printer manufacturers have employed various techniques to differentiate between inkjet cartridges used in different inkjet printers. These techniques range from the obvious altering of the physical dimensions and shape of the inkjet cartridge to very subtle indentations or protrusions positioned at certain locations on the inkjet cartridge. For example, some inkjet printer manufacturers have installed recesses that extend in from the printer's cartridge compartment and are positioned to fit with a protrusion on the inkjet cartridge when the inkjet cartridge is installed inside the printer. In other inkjet printers this arrangement may be reversed. The recess may exist on the inkjet cartridge, and the protrusion may exist inside the inkjet cartridge compartment inside the printer.

As new inkjet printer models are developed, "new" toner cartridges may also be introduced. In some cases, the new inkjet cartridge may contain exactly the same ink and printer head as those of the previous printer model. However, the new inkjet cartridge may have slightly different physical packaging. In some cases, the printer manufacturer may install different keys, or keys in different locations. Changing the size, shape, orientation or location of the keys allows the printer manufacturer to differentiate between previously introduced inkjet cartridges and those of newer models. This may allow the printer manufacturer to increase his margins by charging the consumer a premium for the new inkjet cartridges.

The differences between inkjet printer cartridges may be very minor. As is explained in greater detail in subsequent sections, some differences between the color inkjet cartridges for the same printer may be the location and size of a tab or set of tabs. In addition, the differences between inkjet cartridges for various printer families may also be minor. For example, the black HP83 inkjet cartridge may be very similar to the black inkjet cartridge used in the HP Edgeline family of printer with only slight physical differences.

The inventive concepts are discussed with reference to the HP83 inkjet cartridges as an illustrative example. However, since the HP83 cartridges and the inkjet cartridges for the HP Edgeline printer families are physically similar, it is intended that these inventive concepts may be applied to these cartridges as well as many other types and styles of inkjet cartridges.

FIG. 1 displays a top view of a prior art inkjet cartridge 100 for use in the black inkjet cartridge compartment of the HP Edgeline family of printers. Located on the cartridge 100 is an ink tank 130 for holding the ink as well as a left set 110 and a right set 111 of printer designation fins 113 which are positioned on an upper portion 105. The printer designation fins 113 align with a printer designation recess (not shown for ease of illustration) located in the black inkjet compartment within the HP Edgeline family of printers. The inkjet cartridge 100 also has a color designation tab 120 positioned on a lower portion 115. The color of ink stored within the ink tank 130 corresponds to the position of the color designation tab 120. As shown in FIG. 1, the position and size of the color designation tab 120 indicates that the cartridge 100 is a black inkjet cartridge.

Figure 2:
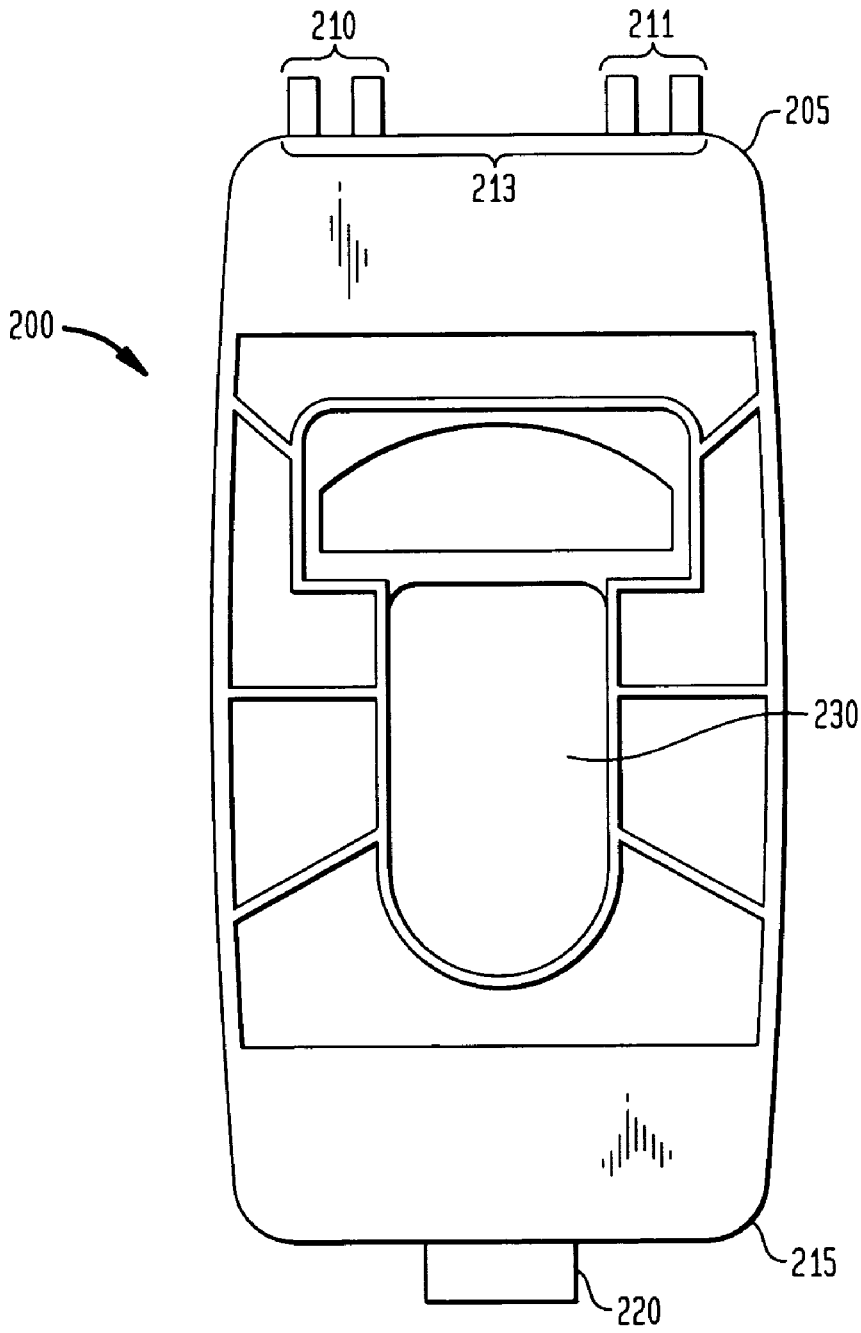
FIG. 2 (PRIOR ART)
FIG. 2 shows a top view of a prior art HP83 black inkjet cartridge.

FIG. 2 displays a top view of a prior art HP83 black inkjet cartridge 200. Similar to the cartridge 100 of FIG. 1, the cartridge 200 has an ink tank 230 for holding ink. The cartridge 200 also has a color designation tab 220 positioned on a lower portion 215. The color of ink stored within the ink tank 230 corresponds to the position of the color designation tab 220. The cartridge 200 has a left set 210 and a right set 211 of printer designation fins 213 as can be seen when comparing the cartridge 100 and cartridge 200, the printer designation fins 113 and 213 respectively are oriented differently. More specifically, the left set 110 is slightly wider than the left set 210. Recesses within the inkjet cartridge compartment on the HP Edgeline family of printers align with the printer designation fins 113 and may be slightly different than the recesses within printers using the HP 83 inkjet cartridge. As displayed in FIGS. 1 and 2, the ink tank 130 of the cartridge 100 may be the same size and shape of the ink tank 230 of cartridge 200. However, due to the spacing and orientation of the printer designation fins 113 and 213, the inkjet cartridges (100 and 200) may not be interchangeable.

The printer cartridges 100 and 200 are typically constructed from molded plastic. As part of the manufacturing process, the printer designation fins (113 and 213) and the color designation tabs (120 and 220) are part of the molded single piece of plastic. Because the printer designation fins (113 and 213) and the color designation tabs (120 and 220) are molded, they are not easily altered. Thus each cartridge (100 and 200) may be operable for a specific color with a specific printer.

Figure 3:
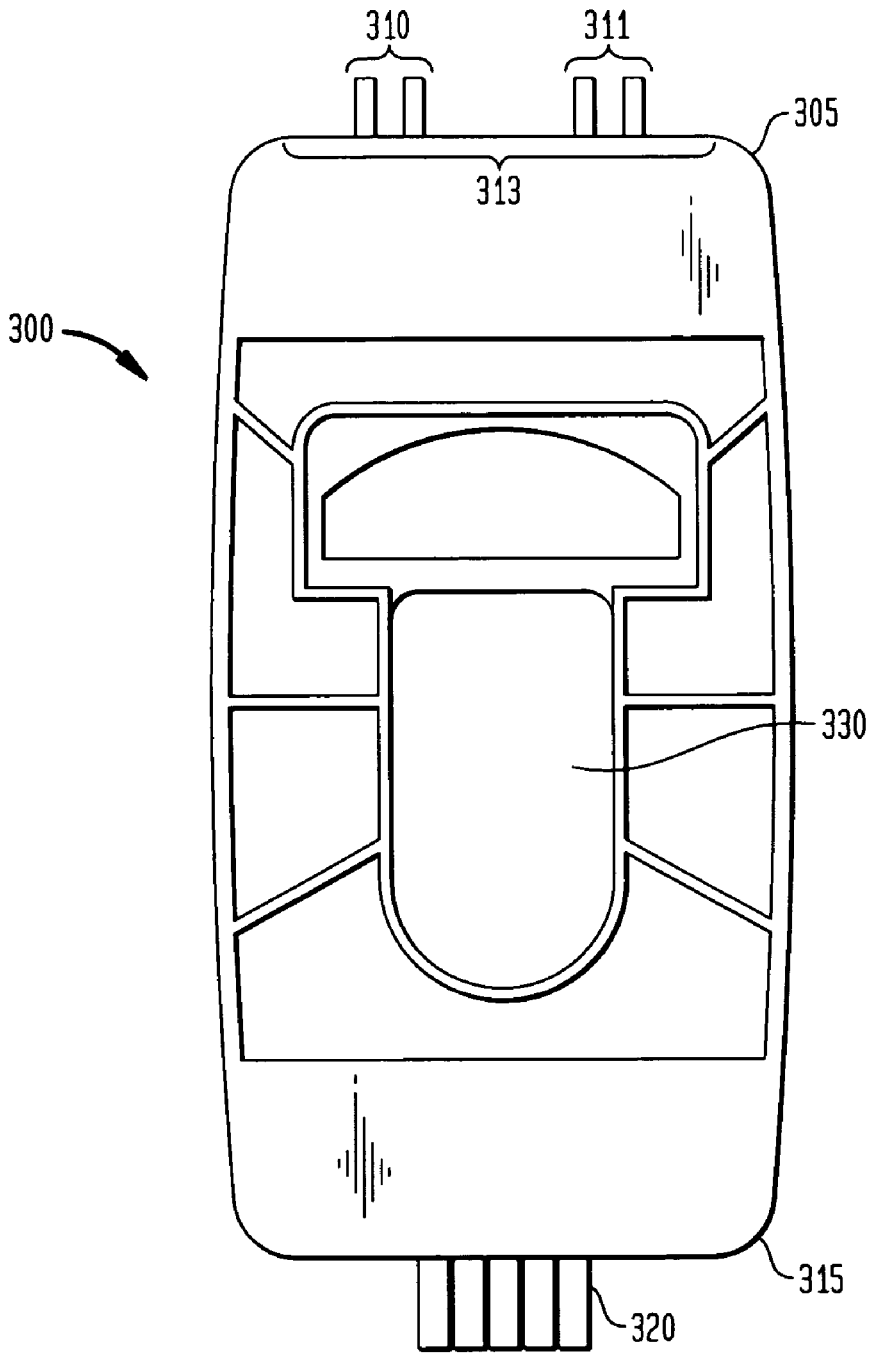
FIG. 3 shows a top view of a universal black inkjet cartridge interchangeable with the HP 83 black inkjet cartridge in accordance with one embodiment of the present invention.
Figure 4:
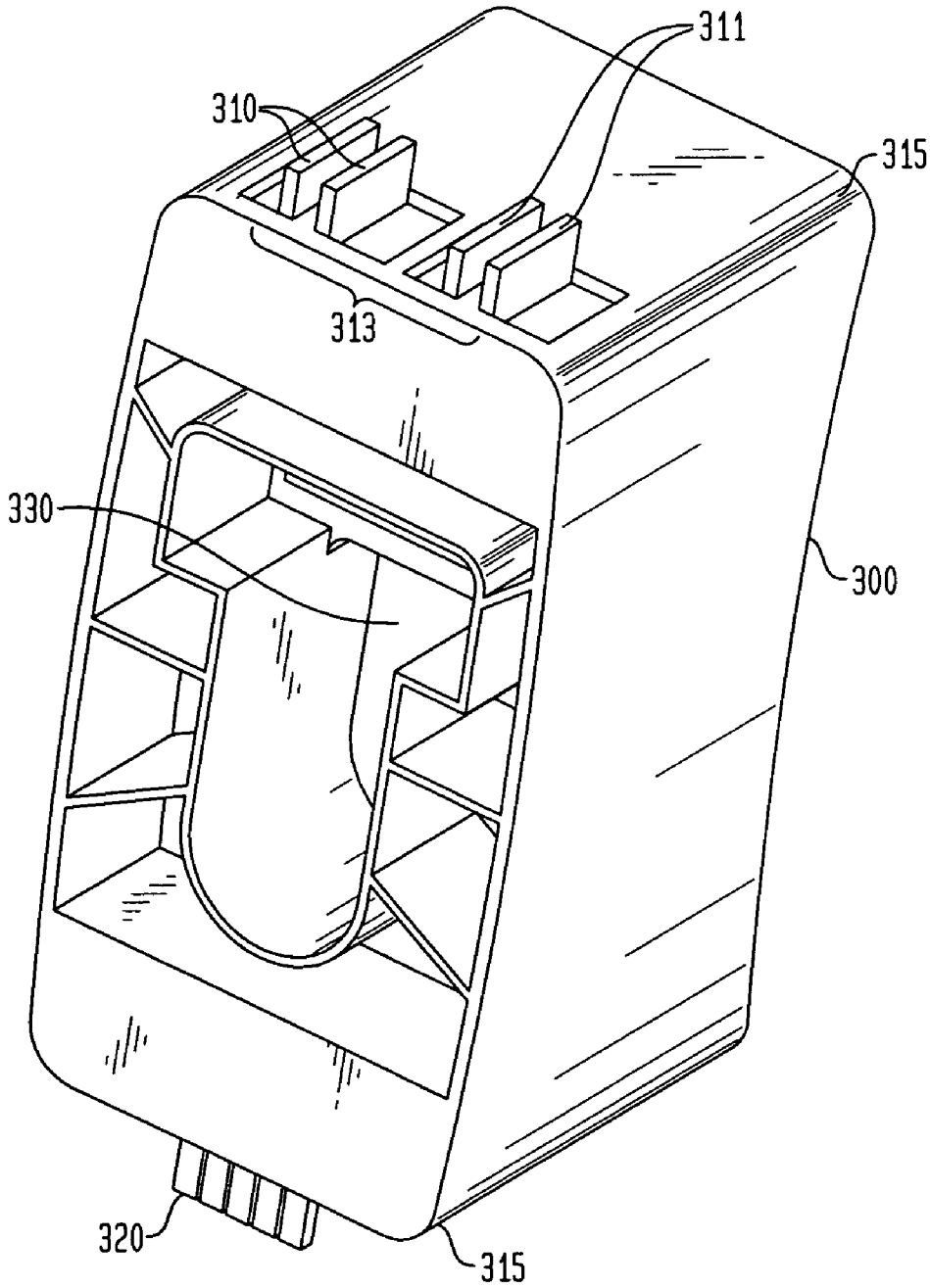
FIG. 4 shows a side perspective view of the universal black inkjet cartridge of FIG. 3.

FIG. 3 displays a universal inkjet cartridge 300 in accordance with one embodiment of the present invention. The inkjet cartridge 300 has an ink tank 320 which stores the ink. Positioned on an upper portion 305 are printer designation fins 313 which consist of a left set 310 and a right set 311. Also positioned on a lower portion 315 are configurable color designation tabs 320. A better view of the printer designation fins 313 is shown in FIG. 4 which displays a perspective view of the universal inkjet cartridge 300. As can be seen in FIG. 4, the configurable printer designation fins 313 may be configured by sliding any the configurable printer designation fins 313 from side to side. Thus, if the universal inkjet cartridge 300 was to be installed as a black HP83 inkjet cartridge, printer designation fins 313 would be positioned as shown in FIG. 4. If the inkjet cartridge 300 was to be installed in the HP Edgeline family of printers, the left set 310 would be spaced apart to the positions as shown in the prior art cartridge 100 of FIG. 1.

Figure 5:
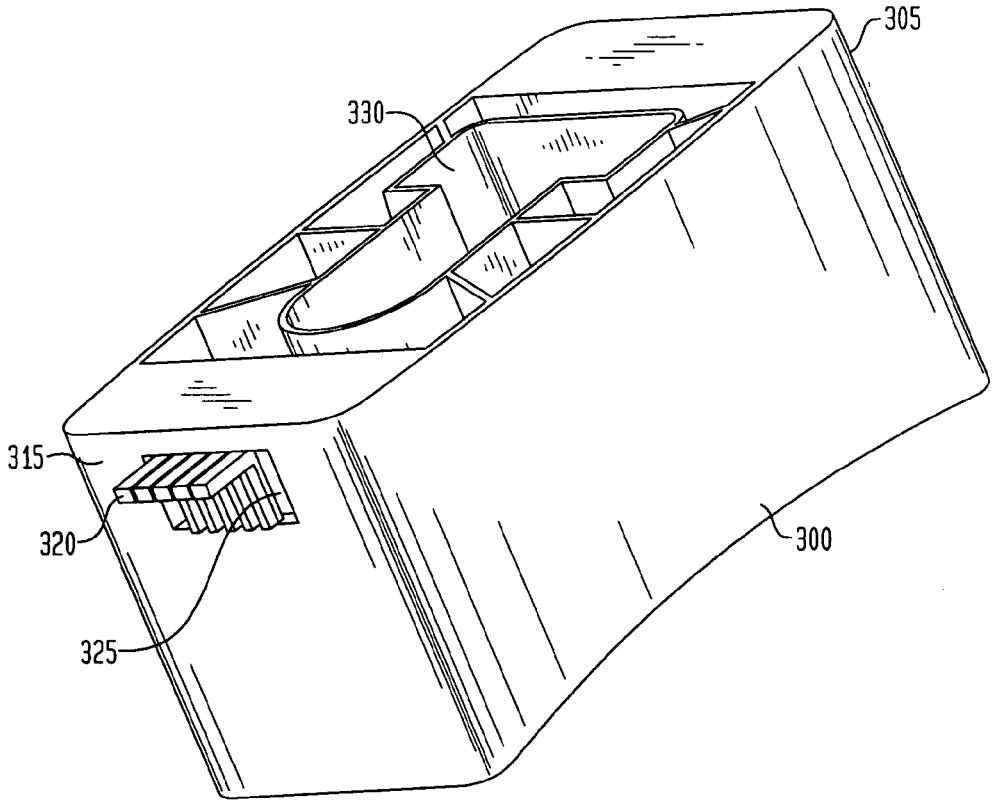
FIG. 5 shows a bottom perspective view of the universal black inkjet cartridge of FIG. 3.

The configurable color designation tabs 320 may be comprised of several smaller tabs. A bottom perspective view of the universal inkjet cartridge 300 is shown in FIG. 5. As can be seen in FIG. 5, the configurable color designation tabs 320 are positioned by swiveling the configurable color designation tabs 320 up from a recess 325 on the lower portion 315. The configurable color designation tabs 320 are configured to reflect the color of the ink stored in the ink tank 330. In an alternative embodiment, the configurable color designation tabs 320 may be individually inserted into the recess 325 and attached into place. In this embodiment, the configurable color designation tabs 320 may be snapped into place or attached using an adhesive means such as epoxy, glue or the like. The configurable color designation tabs 320 are positioned as required in order to configure the inkjet cartridge 300 for the color ink dispensed by the universal inkjet cartridge 300. As displayed in FIGS. 3-5, the universal inkjet cartridge 300 is configured to be interchangeable with an HP 83 black inkjet cartridge.

In another exemplary embodiment, the configurable color designation tabs 320 and/or the configurable printer designation fins 310 of the inkjet cartridge 300 may molded into the upper portion 305 and lower portion 315 respectively. In this arrangement, there may be multiple configurable printer designation fins 313 (more than the 4 shown in FIG. 3) or configurable color designation tabs 320 which may be removed using a wire cutter or other type of cutting tool. This allows an inkjet cartridge remanufacturer to manufacture the universal inkjet cartridge 300 with all the possible combinations of configurable printer designation fins 313 and configurable color designation tabs 320. When a specific inkjet cartridge configuration is required, the inkjet cartridge manufacturer removes the appropriate configurable printer designation fins 313 or configurable color designation tabs 320.

Figure 6:
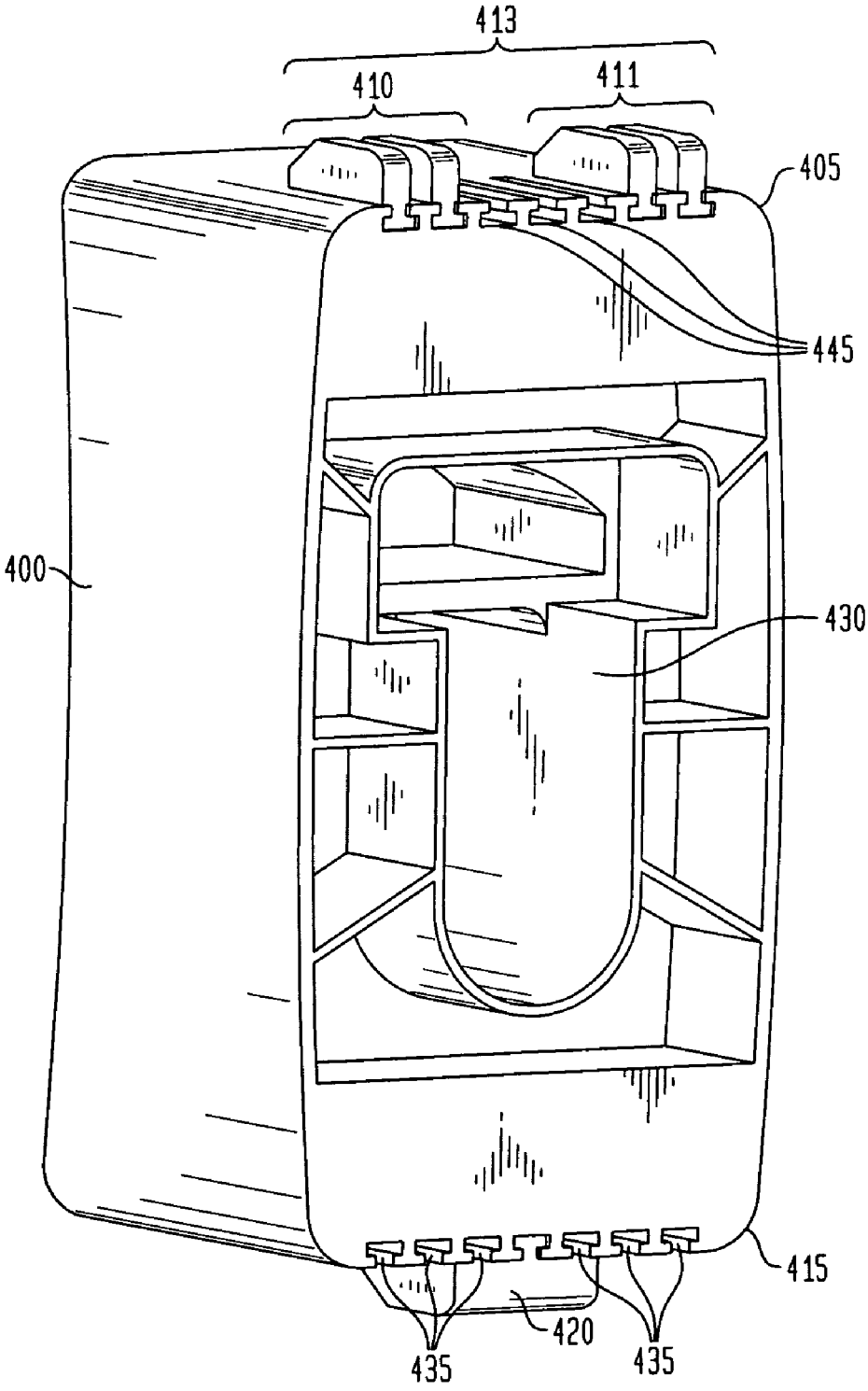
FIG. 6 shows a perspective view of a universal black inkjet cartridge interchangeable with the HP 83 black inkjet cartridge in accordance with another embodiment of the present invention.

FIG. 6 displays yet another universal inkjet cartridge 400 in accordance with another embodiment of the present invention. The universal inkjet cartridge 400 has an ink tank 430 which stores the ink Positioned on an upper portion 405 are configurable printer designation fins 413. Also positioned on a lower portion 415 are configurable color designation tabs 420. The universal inkjet cartridge 400 has configurable printer designation fins 413 which are comprised of a left set 410 and a right set 411. As can be seen in FIG. 6, the configurable printer designation fins 413 may be removed and inserted into printer designation fin slots 445 located on the upper portion 405. The universal inkjet cartridge 400 is configured by inserting the configurable printer designation fins 413 into the appropriate printer designation fin slot 445. Thus if the universal inkjet cartridge 400 was to be interchangeable with the HP 83 black inkjet cartridge, the configurable printer designation fins 413 would be positioned as shown in FIG. 6. If the inkjet cartridge 400 was to be installed in the HP Edgeline family of printers, the left set 410 of the cartridge 400 would be positioned to mirror the printer designation fin positions as shown in the prior art cartridge 100 of FIG. 1.

Positioned on the lower portion 415 of the inkjet cartridge 400 may be configurable color designation tabs 420. Even though only one configurable color designation tab 420 is shown in FIG. 6, the configurable color designation tab 420 may be of various widths. With the configurable color designation tab 420 installed in the location as illustrated in FIG. 6, the universal inkjet cartridge 400 is configured to be interchangeable with the HP83 black inkjet cartridge.

Figure 7:
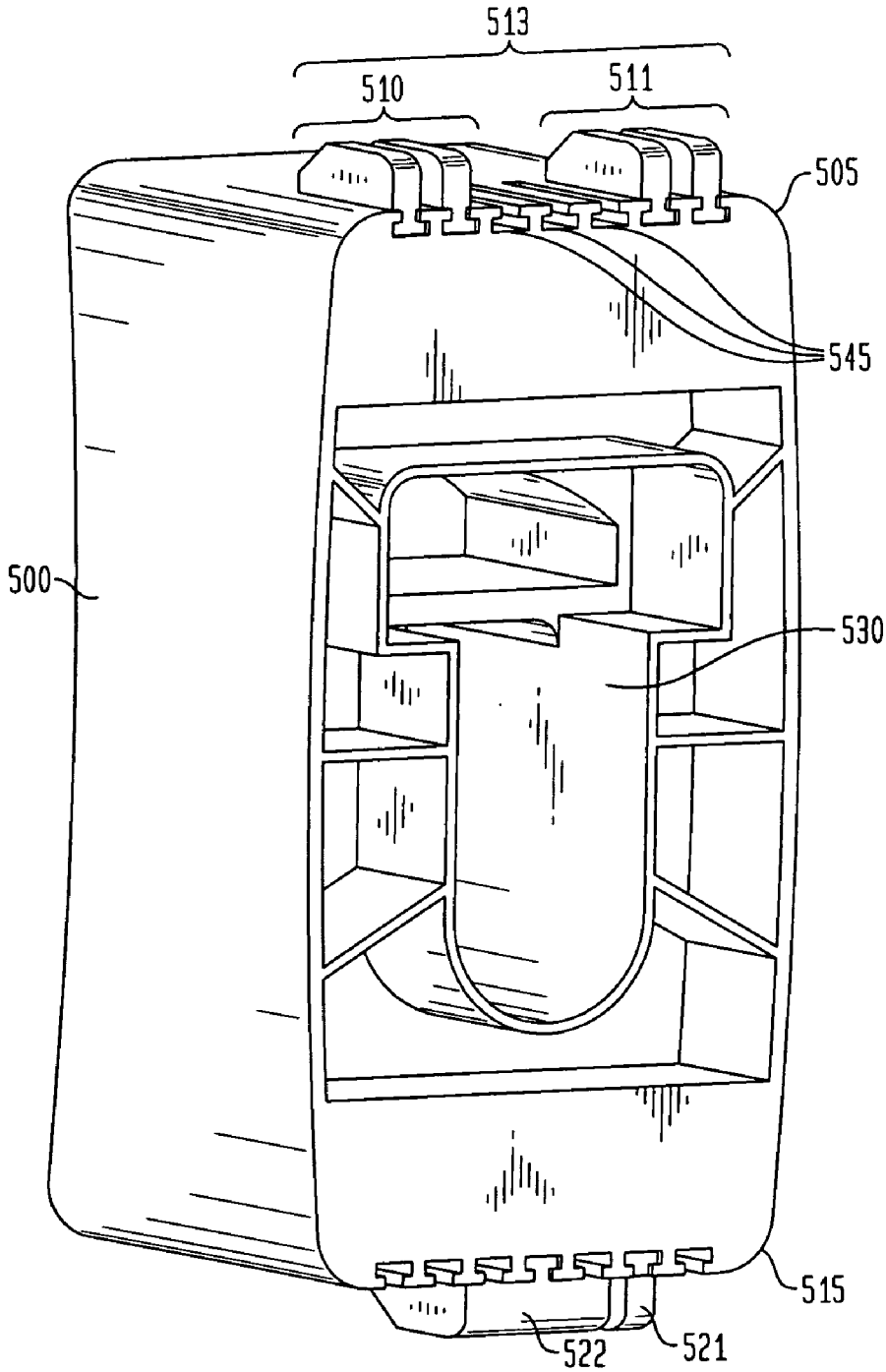
FIG. 7 shows a perspective view of a universal cyan inkjet cartridge interchangeable with an HP 83 cyan inkjet cartridge in accordance with yet another embodiment of the present invention.

FIG. 7 displays another universal inkjet cartridge 500 in accordance with another embodiment of the present invention. The universal inkjet cartridge 500 has an ink tank 530 which stores the ink Positioned on an upper portion 505 are configurable printer designation fins 513 which have a left set 510 and a right set 511. Also positioned on a lower portion 515 are configurable color designation tabs 521 and 522. Similar to the universal inkjet cartridge 400 of FIG. 6, the configurable printer designation fins 513 may be removed and inserted into printer designation fin slots 545 located on the upper portion 505. The universal inkjet cartridge 500 is configured by inserting the configurable printer designation fins 513 into the appropriate printer designation fin slot 545.

The configurable printer designation fins 513 of the universal inkjet cartridge 500 are similar to the configurable printer designation fins 413 of the universal inkjet cartridge 400 (FIG. 6). As can be seen in FIG. 7, one difference between the universal inkjet cartridge 500 and the universal inkjet cartridge 400 is that the universal inkjet cartridge 500 has two color designation tabs 521 and 522. In addition, the color designation tab 522 is slightly smaller than the color designation tab 420 (FIG. 6). With the configurable printer designation fins 513 and the configurable color designation tabs 521 and 522 positioned as shown in FIG. 7, the universal inkjet cartridge 500 may interchangeable with an HP83 cyan inkjet cartridge.

Figure 8:
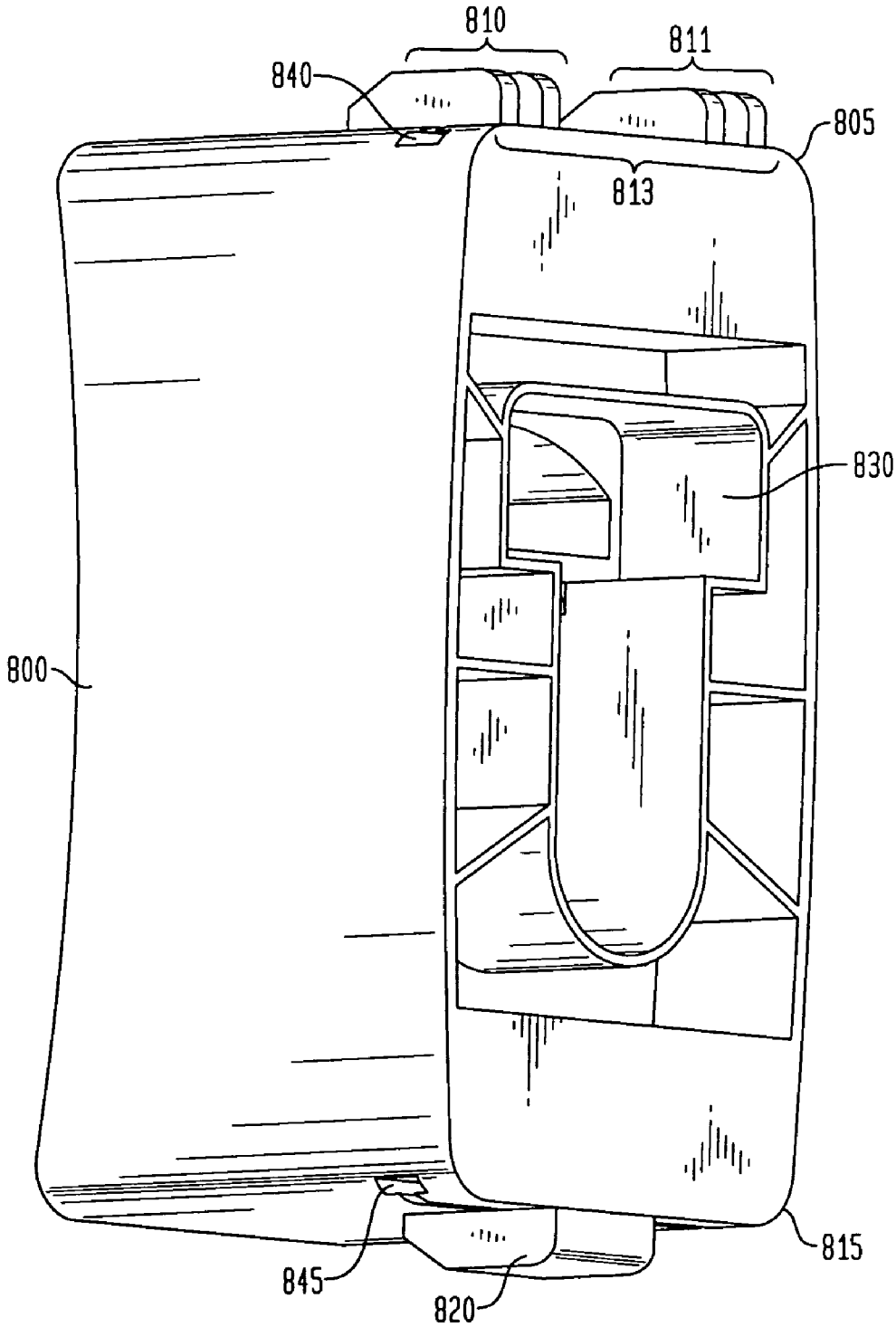
FIG. 8 shows a perspective view of a universal black inkjet cartridge interchangeable with an HP 83 inkjet cartridge in accordance with another embodiment of the present invention.

FIG. 8 displays yet another universal inkjet cartridge 800 in accordance with another embodiment of the present invention. The universal inkjet cartridge 800 has an ink tank 830 which stores the ink Positioned on an upper portion 805 are configurable printer designation fins 813 which are comprised of a left set 810 and a right set 811. Also positioned on a lower portion 815 are configurable color designation tabs 820. As can be seen in FIG. 8, the configurable printer designation fins 813 may be repositioned by sliding the configurable printer designation fins 810 along a configurable printer designation fin track 840. The configurable printer designation fin track 840 runs from one side of the upper portion 805 to the other. In one embodiment, the configurable printer designation fins 813 may be individually positioned within the configurable printer designation fin track 840. In an alternative embodiment the left set 810 and right set 811 may be affixed together in pairs and may be repositioned as a pair.

Positioned on the lower portion 815 of the inkjet cartridge 800 are configurable color designation tabs 820. Even though only one configurable color designation tab 820 is shown in FIG. 8, the universal inkjet cartridge 800 may have multiple color designation tabs 820. The configurable color designation tab 820 may be installed within a configurable color designation tab track 845 which may run from one side of the universal inkjet cartridge 800 to the other side. With the configurable printer designation fins 813 and the configurable color designation tabs 820 positioned as shown in FIG. 8, the universal inkjet cartridge 800 may be interchangeable with a black HP 83 inkjet cartridge.

Figure 9:
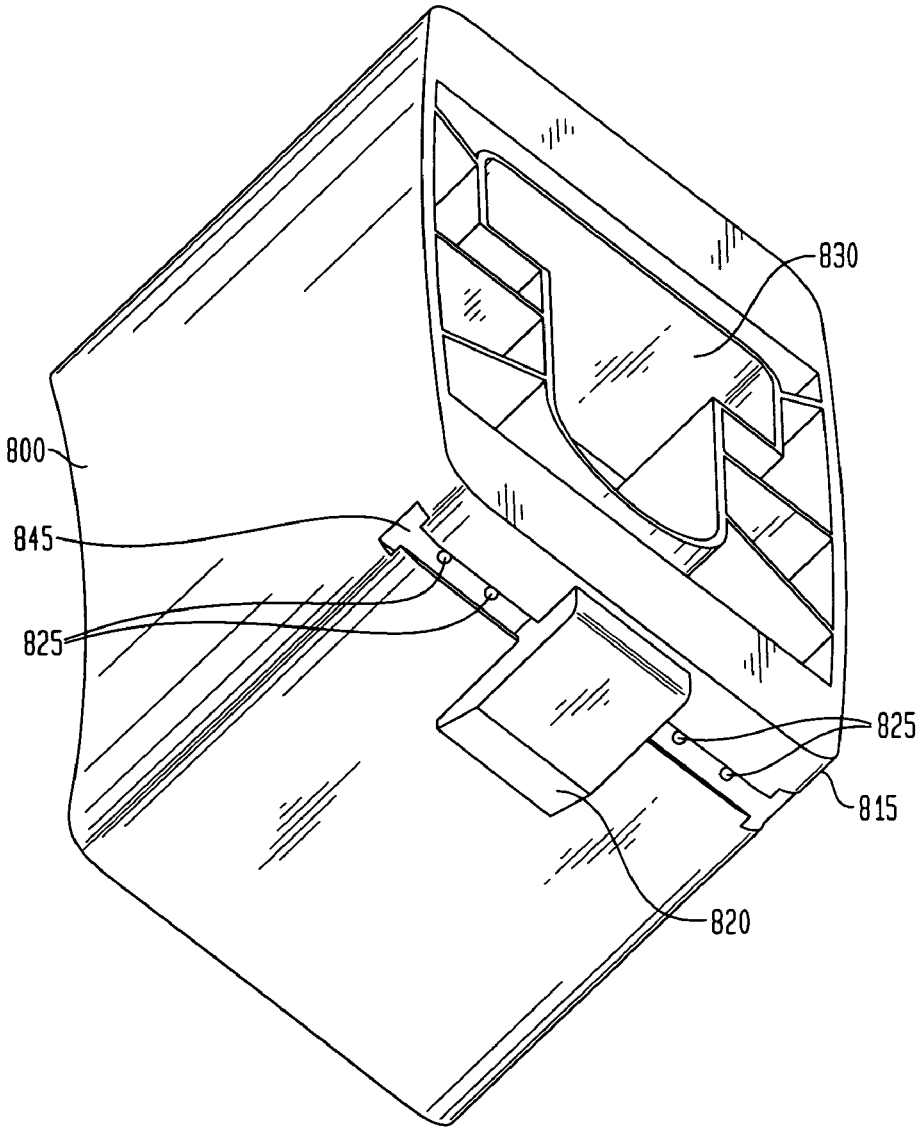
FIG. 9 shows a bottom perspective view of the universal black inkjet cartridge of FIG. 8.

FIG. 9 displays a bottom perspective view of the inkjet cartridge 800. The configurable color designation tabs 820 may have a slight protrusion (not shown for ease of illustration) that extends into the configurable color designation tab track 845. Within the configurable color designation tab track 845 may be depressions 825 positioned at predetermined locations. The predetermined locations may align with potential positions of the configurable color designation tab 820. Using the depressions 825 allows the configurable color designation tabs 820 to be installed at predetermined positions that may correspond to specific colors. The same type of protrusion/depression design may also be applied to the configurable printer designation fins 813 and the configurable printer designation fin track 840 respectively.

Figure 10:
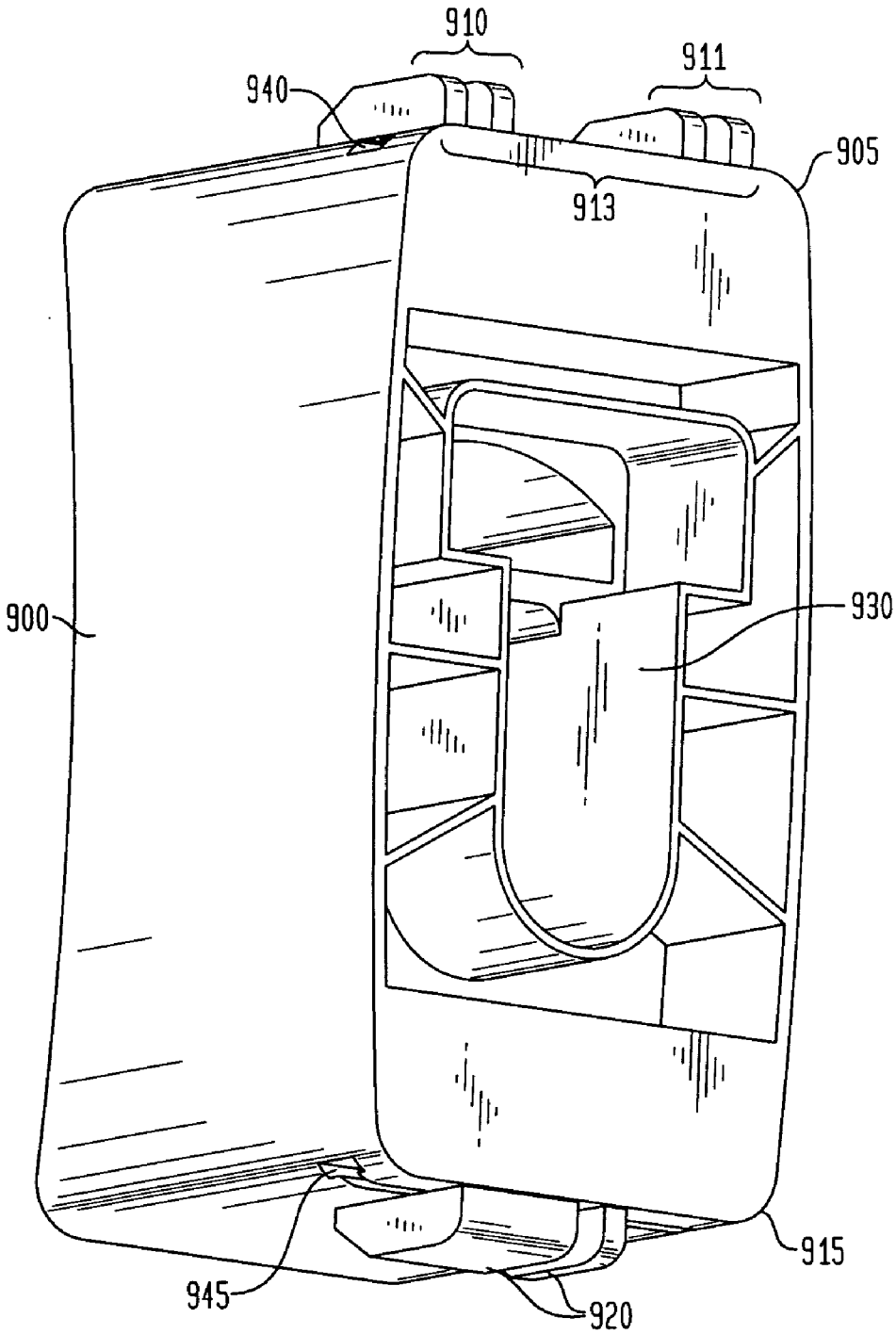
FIG. 10 shows a perspective view of a universal cyan inkjet cartridge interchangeable with an HP 83 cyan inkjet cartridge in accordance with one embodiment of the present invention.

FIG. 10 displays a universal inkjet cartridge 900 in accordance with another embodiment of the present invention. The inkjet cartridge 900 has configurable printer designation fins 913 further comprising a left set 910 and a right set 911. The configurable printer designation fins 913 may be positioned within a configurable printer designation fin track 940. The configurable printer designation fins 913 and the configurable printer designation fin track 940 are located on an upper portion 905 of the inkjet cartridge 900. Located on a lower portion 915 are configurable color designation tabs 920 which are installed within a configurable color designation tab track 945 which may run from one side of the universal inkjet cartridge 900 to the other side. With the configurable printer designation fins 913 and the configurable color designation tabs 920 positioned as shown in FIG. 8, the universal inkjet cartridge 800 may be interchangeable with a cyan HP 83 inkjet cartridge.

Figure 11:
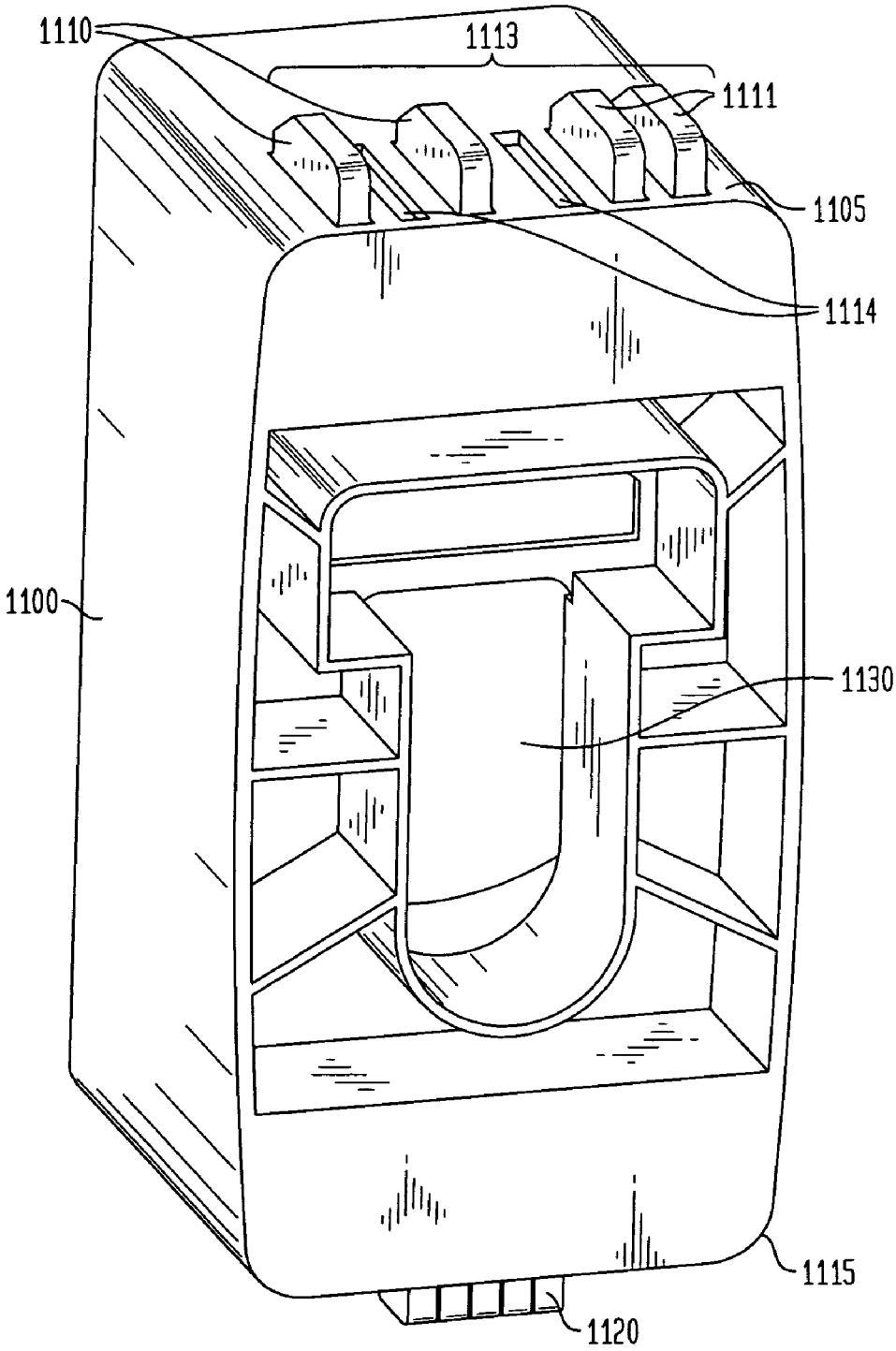
FIG. 11 shows a perspective view of a universal black inkjet cartridge interchangeable with the HP83 black inkjet cartridge in accordance with another embodiment of the present invention.

FIG. 11 displays another universal inkjet cartridge 1100 in accordance with another embodiment of the present invention. The inkjet cartridge 1100 has configurable printer designation fins 1113 further comprising a left set 1110 and a right set 1111 positioned on an upper portion 1105. The configurable printer designation fins 1113 may be positioned into predetermined configurable printer designation fin slots 1114. In this embodiment, the predetermined configurable printer designation fin slots 1114 may extend partially into but not completely through the upper portion 1105. The configurable printer designation fins 1113 may be inserted into the predetermined configurable printer designation fin slots 1114 and affixed into place by pressure or by the use of an affixing means such as glue, epoxy or the like.

Located on a lower portion 1115 of the universal inkjet cartridge 1100 are configurable color designation tabs 1120 which may be installed within predetermined configurable color designation tab slots, similar to the predetermined configurable printer designation fin slots 1114. With the configurable printer designation fins 1113 and the configurable color designation tabs 1120 positioned as shown in FIG. 11, the universal inkjet cartridge 1100 may be interchangeable with a black inkjet cartridge used in the HP Edgeline family of printers.

Figure 12:
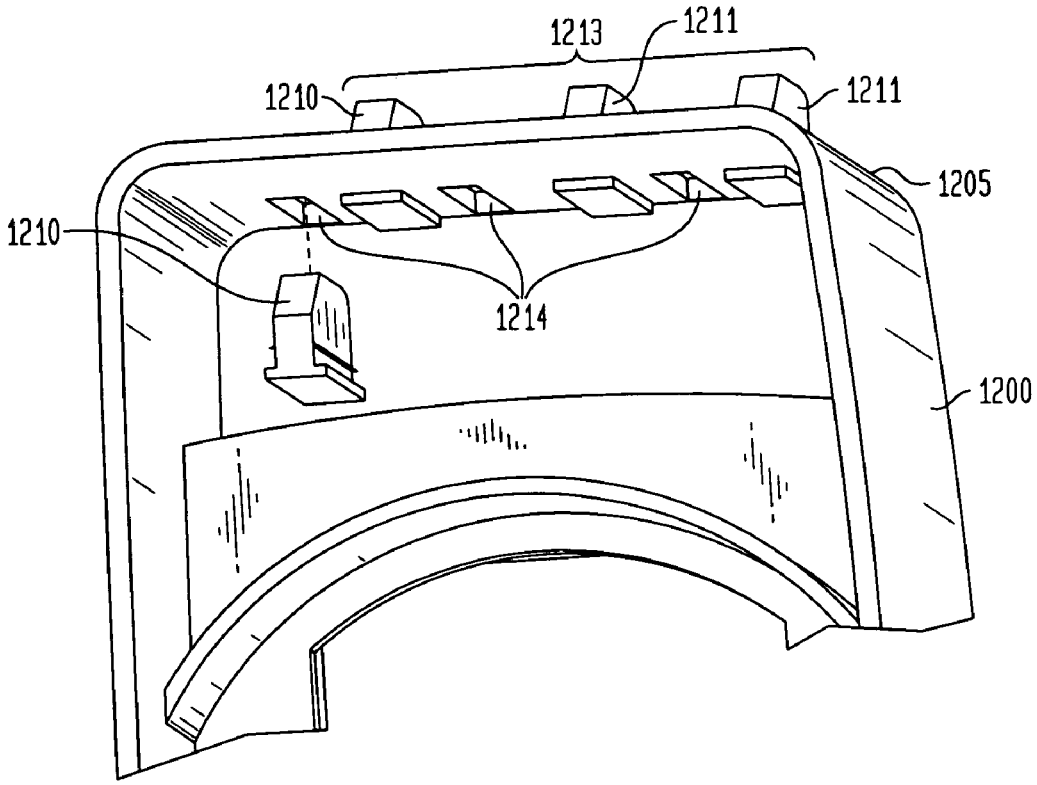
FIG. 12 shows a cut away view of a universal inkjet cartridge in accordance with another embodiment of the present invention.

FIG. 12 displays a cutaway view of yet another universal inkjet cartridge 1200 in accordance with another embodiment of the present invention. The inkjet cartridge 1200 has configurable printer designation fins 1213 further comprising a left set 1210 and a right set 1211 positioned on an upper portion 1205. The configurable printer designation fins 1213 may be positioned into predetermined configurable printer designation fin slots 1214. In this embodiment, the predetermined configurable printer designation fin slots 1214 may extend completely through the upper portion 1205. In this embodiment, the configurable printer designation fins 1213 may be inserted through and extend out of the upper portion 1205. In one embodiment, the predetermined configurable printer designation fin slots 1214 may be holes. In this embodiment, the holes may have removable grommets (not shown for ease of illustration) which seal the hole and prevent dust or other contaminants from entering the universal inkjet cartridge 1200. Alternatively, the holes maybe covered with tape or other covering means. The grommets may be removed and configurable printer designation fins 1213 may be inserted through the holes. The configurable printer designation fins 1213 may affixed into place by pressure or by the use of an affixing means such as glue, epoxy or the like. In this embodiment the configurable printer designation fins 1213 and the grommets may be composed of a soft plastic or rubber.

In addition to the physical differences, the imaging process cartridge manufacturers may use electronic means to differentiate between imaging process cartridge types. The printer may communicate with an electronic chip which may be installed on the inkjet cartridge. When configuring the various embodiments of the universal inkjet cartridge that utilize an electronic chip, the electronic chip corresponding to the configuration of the universal inkjet cartridge should be installed. For example if a universal inkjet cartridge is configured for a black inkjet cartridge, a black inkjet cartridge chip may need to be installed if the universal inkjet cartridge is inserted in an inkjet printer that communicates with the electronic chip.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An universal inkjet cartridge usable in an inkjet printer, the inkjet cartridge comprising:

an inkjet tank, the inkjet tank storing ink and having an upper portion and a lower portion, mounted on the lower portion is a configurable color identification tab and mounted on the upper portion are printer designation fins, the configurable color identification tab is moveable to one of a plurality of color identification positions to allow the universal inkjet cartridge to be used in an inkjet cartridge location within the inkjet printer identified by the printer designation fins, wherein the configurable color identification tab may be positioned into one of the plurality of color identification positions by sliding the configurable color identification tab along a configurable color identification tab track.

2. The universal inkjet cartridge of claim 1 wherein the configurable color identification tab further comprises a plurality of configurable color identification tabs that are each moveable.

3. An universal inkjet cartridge usable in an inkjet printer, the inkjet cartridge comprising:

an inkjet tank, the inkjet tank storing ink and having an upper surface and a lower surface, mounted on the lower surface are color identification tabs and mounted on the upper surface are configurable printer identification fins, the configurable printer identification fins are moveable to be positioned in one of a plurality of configurable printer positions to allow the universal inkjet cartridge to be used in a color inkjet cartridge location in multiple inkjet printers identified by the configurable printer identification fins, wherein the configurable printer identification fins may be positioned into one of the plurality of printer identification positions by sliding the configurable printer identification fins along a configurable printer identification fin track.

4. An universal inkjet cartridge usable in an inkjet printer, the inkjet cartridge comprising:

an inkjet tank, the inkjet tank storing ink and having an upper surface and a lower surface, mounted on the lower surface is a configurable color identification tab and mounted on the upper surface are configurable printer identification fins, the configurable color identification tab is changeable to one of a plurality of color identification positions to allow the universal inkjet cartridge to be used in multiple inkjet cartridge locations within the inkjet printer and the configurable printer identification fins are changeable such that the universal inkjet cartridge is compatible in multiple inkjet printers, wherein the configurable color identification tab may be positioned into one of the plurality of color identification positions by sliding the configurable color identification tab along a configurable color identification tab track.

5. The universal inkjet cartridge of claim 4 wherein the configurable color identification tab further comprises a plurality of configurable color identification tabs that are each changeable.

6. An universal inkjet cartridge usable in an inkjet printer, the inkjet cartridge comprising:

an inkjet tank, the inkjet tank storing ink and having an upper surface and a lower surface, mounted on the lower surface is a configurable color identification tab and mounted on the upper surface are configurable printer identification fins, the configurable color identification tab is changeable to one of a plurality of color identification positions to allow the universal inkjet cartridge to be used in multiple inkjet cartridge locations within the inkjet printer and the configurable printer identification fins are changeable such that the universal inkjet cartridge is compatible in multiple inkjet printers, wherein the configurable printer identification fins may be positioned into one of the plurality of printer identification positions by sliding the configurable printer identification fins along a configurable printer identification fin track.

* * * * *